US007857705B1

(12) United States Patent
Galloway

(10) Patent No.: US 7,857,705 B1
(45) Date of Patent: Dec. 28, 2010

(54) AUDITORY FEEDBACK FOR GOLFERS' FACE CLOSURE RATE

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 12/627,830

(22) Filed: Nov. 30, 2009

Related U.S. Application Data

(60) Provisional application No. 61/140,573, filed on Dec. 23, 2008.

(51) Int. Cl.
*A63B 69/36* (2006.01)

(52) U.S. Cl. ..... 473/224; 473/223; 473/409; 473/221

(58) Field of Classification Search ..... 473/219–224, 473/226, 231, 232, 234, 457, 409
See application file for complete search history.

(56) References Cited

U.S. PATENT DOCUMENTS 3,808,707 A * 5/1974 Fink ..... 434/252
4,789,160 A * 12/1988 Dollar et al. ..... 473/223
5,184,826 A * 2/1993 Hall, Jr. ..... 473/224
5,911,635 A * 6/1999 Ogden ..... 473/224
5,941,779 A * 8/1999 Zeiner-Gundersen ..... 473/224
6,001,023 A * 12/1999 Sanchez et al. ..... 473/217
6,224,493 B1 5/2001 Lee et al.
6,441,745 B1 8/2002 Gates
6,638,175 B2 10/2003 Lee et al.
6,739,981 B1 * 5/2004 Lin ..... 473/219
7,207,896 B1 4/2007 Sudol
7,264,555 B2 9/2007 Lee et al.
7,331,875 B2 * 2/2008 Sherman ..... 473/221
7,749,109 B2 * 7/2010 Jang et al. ..... 473/409

* cited by examiner

*Primary Examiner*—Nini Legesse
(74) *Attorney, Agent, or Firm*—Michael A. Catania

(57) ABSTRACT

A device to improve the feedback to the golfer relative to the rotation of the club head and thus provide valuable feedback to the golfer on the rate and timing of the club head rotation to golf ball impact is disclosed herein. The device is a training and practice aid to accomplish such auditory feedback.

3 Claims, 2 Drawing Sheets

AUDITORY FEEDBACK FOR GOLFERS' FACE CLOSURE RATE

CROSS REFERENCES TO RELATED APPLICATIONS

The present application claims priority to U.S. Provisional Patent Application No. 61/140,573, filed on Dec. 23, 2008.

STATEMENT REGARDING FEDERALLY SPONSORED RESEARCH OR DEVELOPMENT

Not Applicable

BACKGROUND OF THE INVENTION

1. Field of the Invention

The present invention relates to a golf club swing training device.

2. Description of the Related Art

The prior art discloses training aids and auditory swing training aids. However, the prior art fails to provide an auditory feedback training aid for a golfer's face closure rate.

One example of a training aid is disclosed in U.S. Pat. No. 7,207,896 issued to Sudol for Aid for Training a Golf Swing. This patent discloses two laser pointers that are mounted at opposite ends of a bar that is affixed to a hat. The laser pointers are horizontally and vertically adjustable and are adjusted such that the laser beams from the two laser pointers cross at a desired point in front of the user.

Another example is U.S. Pat. No. 6,638,175 issued to Lee et al., for Diagnostic Golf Club System, which discloses a diagnostic golf club that has a plurality of strain gauges, an internal power supply, and a non-volatile memory for capturing data relating to a golf swing. The interface means is capable of transferring data from the diagnostic golf club to the computing means for processing the data and presenting the data in a useful and informative format.

Yet another example is U.S. Pat. No. 6,441,745 issued to Gates for Golf Club Swing Path, Speed and Grip Pressure Monitor, which discloses an acceleration monitor assembly for measuring acceleration forces on a golf club head during the swing of the golf club.

Golf is a difficult game and golfers routinely seek methods to improve performance. Practice and instruction are some primary paths to improving one's golf game. Because the swing mechanics of golf are a complex and often subtle series of timed movements of the golfer's body, learning is difficult without the aid of objective observation and feedback. One of the more important timed sequences is that of timing the lateral orientation of the club face to the velocity direction of the club center of mass, face angle along head path. The face angle rotation and closure rate cannot readily be observed by the golfer or instructor during the swing and the recognition of correlation between the face angle, body movements, and ball flight are disjointed such that learning is difficult.

BRIEF SUMMARY OF THE INVENTION

The present invention seeks to improve the feedback to the golfer relative to the rotation of the club head and thus provide valuable feedback to the golfer on the rate and timing of the club head rotation to golf ball impact. The present invention is a training and practice aid to accomplish such auditory feedback.

The device of the present invention comprises a housing with a rate sensor disposed within the housing. The rate sensor generates an electronic signal corresponding to an angular momentum generated by the golfer during a golf swing. Additionally, an amplifier circuit is disposed within the housing. The amplifier circuit is in electrical communication with the rate sensor. The amplifier circuit amplifies the electrical signal generated by the rate sensor to create an amplified signal. Also, a speaker is disposed within the housing. The speaker is in electrical communication with the amplifier circuit to generate an audible signal corresponding to the amplified signal. The audible signal has a pitch based on the angular momentum generated by the golfer during the golfer swing. Lastly, a power source is disposed within the housing. The power source provides power to the rate sensor, the amplifier circuit and the speaker.

The invention further comprises a method for using the device to provide auditory feedback to a golfer to improve the golfer's swing by closure of the face. The method comprises swinging a golf club having a device removably attached thereto. The device generates a first audible signal based on a first rotation of the golf club during the swing.

The golf club is swung a second time with a second rotation of the golf club during the swing. This second rotation of the golf club head generates a second audible signal based on a second rotation of the golf club during the swing.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
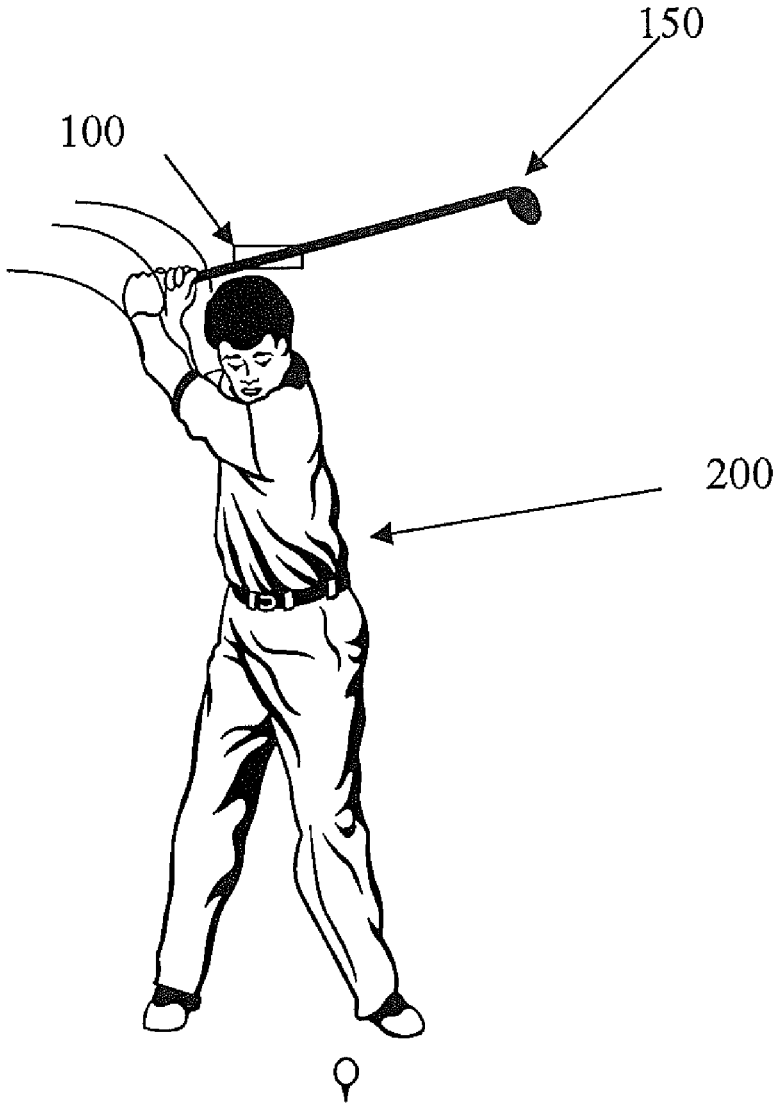
FIG. 1 is a perspective view of the invention.

As shown in FIG. 1, the invention involves a modified golf club 150. The present invention comprises a device 100 for attachment to a golf club 150 to provide auditory feedback to a golfer 200. The device 100 comprises a housing with a rate sensor 101, a speaker 102, an amplifier circuit 103 and a power source 104. The device 100 may be removeably attached to a shaft of a golf club 150.

Figure 2:
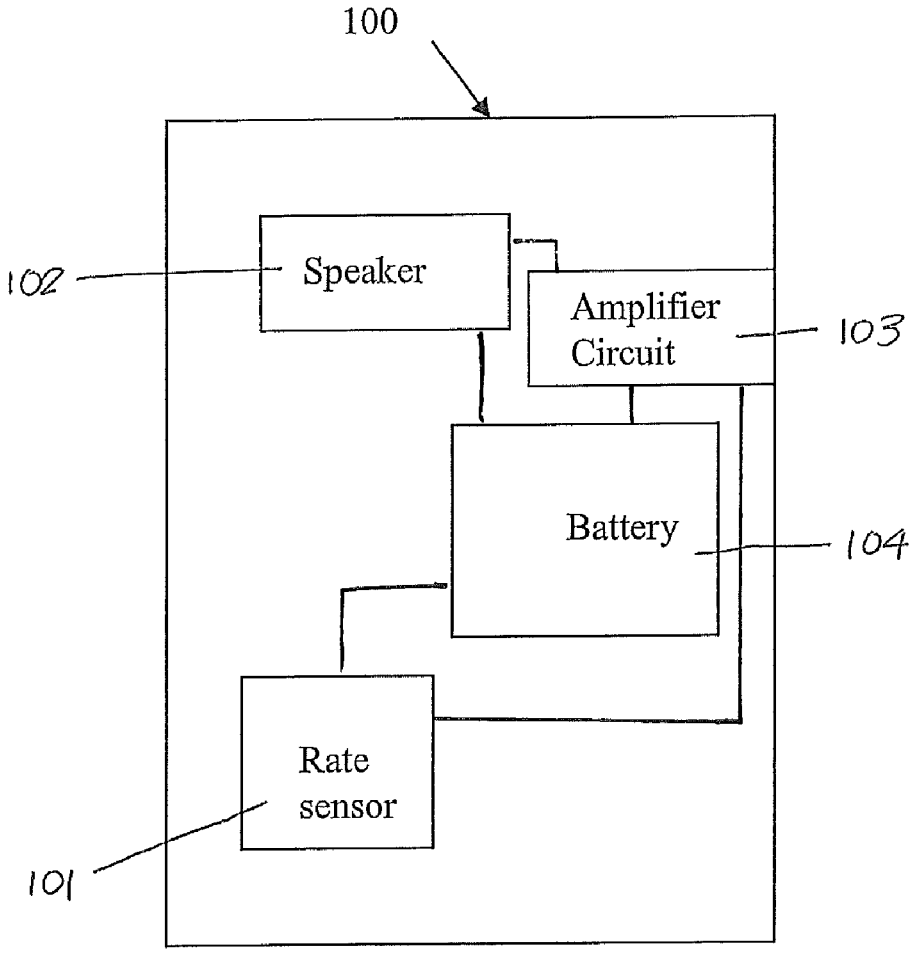
FIG. 2 is a block diagram of the device for providing auditory feedback to a golfer.

The rate sensor 101 generates an electronic signal corresponding to an angular momentum generated by the golfer 200 during a golf swing. The amplifier circuit 103 is in electrical communication with the rate sensor 101, as indicated FIG. 2. The amplifier circuit 103 amplifies the electrical signal generated by the rate sensor 101 to create an amplified signal. As shown in FIG. 2, the speaker 102 is in electrical communication with the amplifier circuit 103 to generate an audible signal corresponding to the amplified signal. The power source 104 provides power to the rate sensor 101, the amplifier circuit 103 and the speaker 102.

The frequency of the generated sound corresponds to the rotation rate of the club 150 when swung by a golfer 200. The invention further comprises a method for using the device 100 to provide auditory feedback to a golfer to improve the golfer's swing by closure of the face.

As shown in FIG. 2, the device 100 preferably utilizes a rate sensor 101, a power source (such as a battery) 104, a miniature speaker component 102, and an amplifier circuit 103 to convert club head rotation rates into sound. The frequency of the emitted sound will correspond to the rotation rate of the club 150. The device 100 will be mounted on a golf club 150 shaft and is preferably detachable such that the device 100 can be used for practice and the golf club 150 can be converted back to approved form for competitive rounds of golf according to the Rules of Golf as set forth by the USGA.

Preferably the device 100 is mounted closer to a golfer 200 on a golf club shaft 150 than farther from the golfer 200, and the speaker 102 of the device 100 is preferably oriented toward the golfer 200.

For each swing and each golfer 200 there is preferably a different profile for the sound of the device 100.

The method of the present invention comprises swinging a golf club having a device 100 removably attached thereto. The device 100 generates a first audible signal based on a first rotation of the golf club 150 during the swing. The golf club 150 is swung a second time with a second rotation of the golf club 150 during the swing. This second rotation of the golf club 150 head generates a second audible signal based on a second rotation of the golf club 150 during the swing. The golfer 200 quickly learns to recognize the rate of the pitch and/or amplitude change and learns to relate the sound to the timing of the face position of the golf club 150. The auditory feedback enables the golfer 200 to improve the golfer's 200 game.

Lee et al., U.S. Pat. No. 6,224,493 for an Instrumented Golf Club System And Method Of Use discloses rate sensors as is hereby incorporated by reference in its entirety. Lee et al., U.S. Pat. No. 7,264,555 for an Diagnostic Golf Club System discloses rate sensors as is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A device for attachment to a golf club to provide auditory feedback to a golfer, the device comprising:

a housing;

a rate sensor disposed within the housing, the rate sensor generating an electronic signal corresponding to an angular momentum generated by the golfer during a golf swing;

an amplifier circuit disposed within the housing, the amplifier circuit in electrical communication with the rate sensor, the amplifier circuit amplifying the electrical signal generated by the rate sensor to create an amplified signal;

a speaker disposed within the housing, the speaker in electrical communication with the amplifier circuit to generate an audible signal corresponding to the amplified signal, the audible signal having a pitch based on the angular momentum generated by the golfer during the golfer swing; and a power source disposed within the housing, the power source providing power to the rate sensor, the amplifier circuit and the speaker;

wherein a frequency of the generated audible signal corresponds to the rotation rate of the golf club when swung by a golfer.

2. The device according to claim 1 wherein the device is removably attached to a shaft of a golf club.

3. A method for using the device to provide auditory feedback to a golfer to improve the golfer's swing by closure of the face; the method comprising:

swinging a golf club having a device removably attached thereto, the device comprising a housing, a rate sensor disposed within the housing, the rate sensor generating an electronic signal corresponding to an angular momentum generated by the golfer during a golf swing, an amplifier circuit disposed within the housing, the amplifier circuit in electrical communication with the rate sensor, the amplifier circuit amplifying the electrical signal generated by the rate sensor to create an amplified signal, a speaker disposed within the housing, the speaker in electrical communication with the amplifier circuit to generate an audible signal corresponding to the amplified signal, the audible signal having a pitch based on the angular momentum generated by the golfer during the golfer swing, and a power source disposed within the housing, the power source providing power to the rate sensor, the amplifier circuit and the speaker;

generating a first audible signal based on a first rotation of the golf club during the swing;

swinging the golf club a second time with a second rotation of the golf club during the swing; and generating a second audible signal based on a second rotation of the golf club during the swing.

* * * * *